US010161159B2

(12) United States Patent
Zeigler

(10) Patent No.: US 10,161,159 B2
(45) Date of Patent: Dec. 25, 2018

(54) FOLDING FRAME SYSTEM WITH V-SHAPED LEG ASSEMBLY AND FOLDING FOOT ASSEMBLY

(71) Applicant: World Shelters, Inc., Alexandria, VA (US)

(72) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 239 days.

(21) Appl. No.: 15/054,909

(22) Filed: Feb. 26, 2016

(65) Prior Publication Data

US 2017/0247906 A1 Aug. 31, 2017

(51) Int. Cl.

| | |
|---|---|
| ***E04H 15/46*** | (2006.01) |
| ***E04H 15/48*** | (2006.01) |
| ***E04H 15/50*** | (2006.01) |
| *E04H 12/18* | (2006.01) |
| *E04B 1/32* | (2006.01) |

(52) U.S. Cl.

CPC ..... *E04H 15/46* (2013.01); *E04H 15/48* (2013.01); *E04H 15/50* (2013.01); *E04B 1/3205* (2013.01); *E04B 1/3211* (2013.01); *E04H 12/18* (2013.01)

(58) Field of Classification Search

CPC ..... E04H 15/46; E04H 15/48; E04H 15/50; E04H 15/505; E04H 15/38; E04B 1/3205; E04B 1/3211

USPC ..... 135/120.3

See application file for complete search history.

(56) References Cited

U.S. PATENT DOCUMENTS

| | | | |
|---|---|---|---|
| 3,968,808 | A | 7/1976 | Zeigler |
| 4,026,313 | A | 5/1977 | Zeigler |
| 4,280,521 | A | 7/1981 | Zeigler |
| 4,290,244 | A | 9/1981 | Zeigler |
| 4,334,660 | A | 6/1982 | Zeigler |
| 4,437,275 | A | 3/1984 | Zeigler |
| 4,473,986 | A | 10/1984 | Zeigler |
| 4,512,097 | A | 4/1985 | Zeigler |
| 4,522,008 | A | 6/1985 | Zeigler |
| 4,561,618 | A | 12/1985 | Zeigler |
| 4,579,066 | A | 4/1986 | Zeigler |
| 4,637,180 | A | 1/1987 | Zeigler |
| 4,689,932 | A | 9/1987 | Zeigler |
| 4,747,239 | A | 5/1988 | Zeigler |
| 4,761,929 | A | 8/1988 | Zeigler |
| 4,800,663 | A | 1/1989 | Zeigler |
| 4,838,003 | A | 6/1989 | Zeigler |
| 4,970,841 | A | 11/1990 | Zeigler |
| RE33,710 | E | 10/1991 | Zeigler |
| 5,230,196 | A | 7/1993 | Zeigler |
| 5,274,980 | A | 1/1994 | Zeigler |
| 5,444,946 | A | 8/1995 | Zeigler |
| 5,651,228 | A | 7/1997 | Zeigler |
| 6,141,934 | A | 11/2000 | Zeigler |

(Continued)

*Primary Examiner* — David R Dunn
*Assistant Examiner* — Danielle Jackson
(74) *Attorney, Agent, or Firm* — WRB-IP LLP

(57) ABSTRACT

A foot assembly for a V-leg assembly of a folding frame system includes a first U-shaped bracket having two legs connected by a web, a second U-shaped bracket having two legs connected b a web, a cylindrical foot member, and a pivot pin extending through a hole in the web of the first bracket, a hole in the foot member, and a hole in the web of the second bracket so that the first bracket, the foot member, and the second bracket are all pivotable relative to one another about the pivot pin.

3 Claims, 5 Drawing Sheets

(56) References Cited

U.S. PATENT DOCUMENTS

| | | | |
|---|---|---|---|
| 7,357,238 | B2 | 4/2008 | Zeigler |
| 7,455,164 | B2 | 11/2008 | Zeigler |
| 7,478,644 | B2 | 1/2009 | Zeigler |
| 7,533,498 | B2 | 5/2009 | Zeigler |
| 7,556,054 | B2 | 7/2009 | Zeigler |
| 7,712,261 | B2 | 5/2010 | Zeigler |
| 7,832,170 | B2 | 11/2010 | Zeigler |

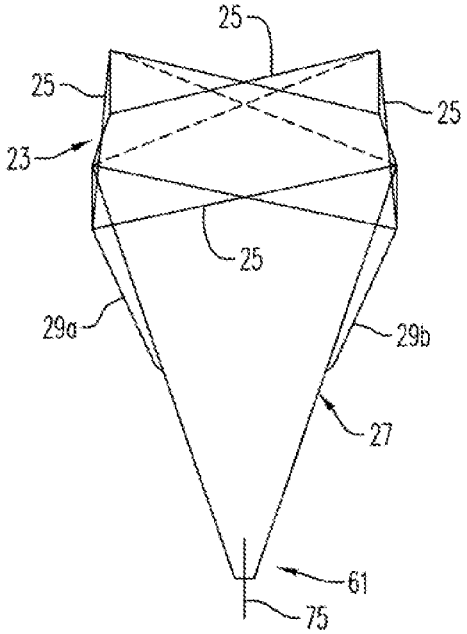
FIG. 3A
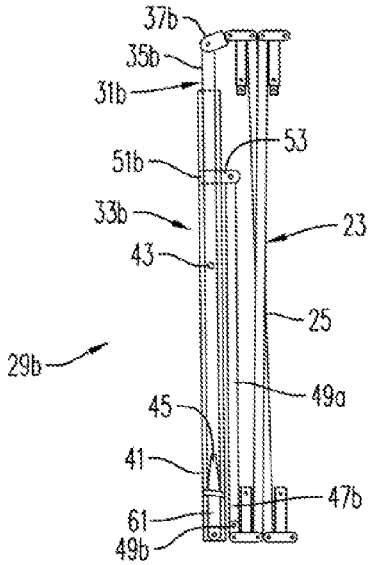
FIG. 3D
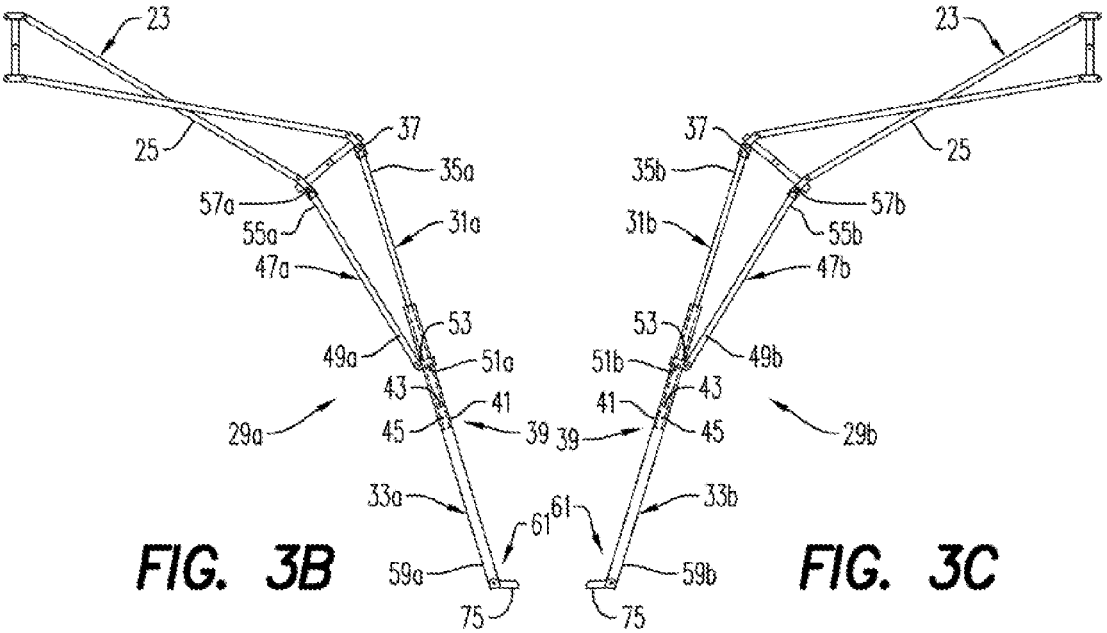
FIG. 3B
FIG. 3C

FOLDING FRAME SYSTEM WITH V-SHAPED LEG ASSEMBLY AND FOLDING FOOT ASSEMBLY

BACKGROUND AND SUMMARY

The present invention relates to folding frame systems and, more particularly, to folding frame systems with V-shaped leg assemblies and folding foot assemblies.

My U.S. Pat. No. 6,141,934 shows a folding frame system with a V-shaped leg assembly and folding foot assembly. The V-shaped leg has been found to be superior in strength to legs formed from single or telescoping struts. It proposes a folding foot assembly at a bottom of the V-shaped leg. It is desirable to provide a more robust folding foot assembly.

According to an aspect of the present invention, a foot assembly for a V-leg assembly of a folding frame system comprises a first U-shaped bracket having two legs connected by a web, a second U-shaped bracket having two legs connected by a web, a cylindrical toot member, and a pivot pin extending, through a hole in the web of the first bracket, a hole in the foot member, and a hole in the web of the second bracket so that the first bracket, the foot member, and the second bracket are all pivotable relative to one another about the pivot pin.

According to another aspect of the present invention, a folding leg assembly is provided for a folding frame system, the folding frame system including at least three pivotably attached strut pairs, the folding frame system being movable between a folding frame closed position in which struts of the at least three strut pairs are disposed parallel to each other and a folding frame open position in which struts of the at least three strut pairs are locked in non-parallel positions and ends of the struts of each strut pair of the at least three strut pairs define a rectangle. The folding leg assembly comprises two leg strut assemblies, each leg strut assembly including a top leg strut and a tubular bottom leg strut in which the top leg strut is telescopingly slidable between a top leg strut closed position and a top leg strut open position, a top end of each top leg strut including a joint for pivotable attachment to an end of a start of a strut pair of the at least three strut pairs of the folding frame system, a lock for locking the top leg strut in the top leg strut open position, and two arm strut assemblies, each arm strut assembly corresponding to a respective leg strut assembly, each arm strut assembly being pivotably attached at a bottom end to a point on the bottom leg strut of the respective leg strut assembly, a top end of each arm strut assembly including a joint for pivotable attachment to an end of a strut of a strut pair of the at least three strut pairs of the folding frame system, wherein the two leg strut assemblies are pivotably attached to each other at bottom ends of bottom leg struts of the two leg strut assemblies, the joints at the top ends of top leg struts of the two leg strut assemblies each being pivotably attached to top ends of struts of the strut pair of the at least three strut pairs, the joints at the top ends of arm strut assemblies of the two arm strut assemblies each being pivotably attached to bottom ends of the struts of the strut pair, and a foot assembly for pivotably attaching the two leg strut assemblies to each other at bottom ends of the bottom leg struts of the two leg strut assemblies, the foot assembly permitting pivotal movement of the two leg strut assemblies, the foot assembly comprising a first U-shaped bracket having two legs connected by, a web, a second U-shaped bracket having two legs connected by a web, a cylindrical foot member, and a pivot pin extending through a hole in the web of the first bracket, a hole in the foot member, and a hole in the web of the second bracket so that the first bracket, the foot member, and the second bracket are all pivotable relative to one another about the pivot pin, each of the first and second U-shaped brackets receiving one of the bottom ends of the bottom leg struts of the two leg strut assemblies between the two legs of the U-shaped bracket, the bottom end of each bottom leg strut of the two leg strut assemblies being pivotably attached to a respective U-shaped bracket by a respective foot pin extending through the two legs of the U-shaped bracket and the bottom end of the bottom leg strut.

According to another aspect of the present invention, a folding frame system comprises a roof assembly including at least three pivotably attached strut pairs, adjacent pairs of at least three pivotably attached strut pairs defining at least three corners of the roof assembly, the roof assembly being movable between a roof assembly closed position in which struts of the at least three strut pairs are disposed parallel to each other and a roof assembly open position in which struts of the at least three strut pairs are locked in non-parallel positions and ends of the struts of each strut pair of the at least three strut pairs define a rectangle, and at least one folding leg assembly attached to the roof assembly, each folding leg assembly comprising two leg strut assemblies, each leg strut assembly including a top leg strut and a tubular bottom leg strut in which the top leg strut is telescopingly slidable between a top leg strut closed position and a top leg strut open position, a top end of each top leg strut including a joint for pivotable attachment to an end of a strut of a strut pair of the at least three strut pairs of the roof assembly, a lock for locking the top leg strut in the top leg strut open position, two arm strut assemblies, each arm strut assembly corresponding to a respective leg strut assembly, each arm strut assembly being pivotably attached at a bottom end to a point on the bottom leg strut of the respective leg strut assembly, a top end of each arm strut assembly including a joint for pivotable attachment to an end of a strut of a strut pair of the at least three strut pairs of the roof assembly, wherein the two leg strut assemblies are pivotably attached to each other at bottom ends of bottom leg struts of the two leg strut assemblies, the joints at the top ends of top leg struts of the two leg strut assemblies each being pivotably attachable to top ends, of struts of the strut pair of the at least three strut pairs, the joints at the top ends of arm strut assemblies of the two arm strut assemblies each being pivotably attachable to bottom ends of the struts of the strut pair, a foot assembly for pivotably attaching the two leg strut assemblies to each other at bottom ends of the bottom leg struts of the two leg strut assemblies, the foot assembly permitting pivotal movement of the two leg strut assemblies, the foot assembly comprising a first U-shaped bracket having two legs connected by a web, a second U-shaped bracket having two legs connected by a web, a cylindrical foot member, and a pivot pin extending through a hole in the web of the first bracket, a hole in the foot member, and a hole in the web of the second bracket so that the first bracket, the foot member, and the second bracket are all pivotable relative to one another about the pivot pin, each of the first and second U-shaped brackets receiving one of the bottom ends of the bottom leg struts of the two leg strut assemblies between the two legs of the U-shaped bracket, the bottom end of each bottom leg strut of the two leg strut assemblies being pivotably attached to a respective U-shaped bracket by a respective foot pin extending through the two legs of the U-shaped bracket and the bottom end of the bottom leg strut.

According to still another an aspect of the present invention, a folding leg assembly for a folding frame system is provided, the folding frame system including at least three pivotably attached strut pairs, the folding frame system being movable between a folding frame closed position in which struts of the at least three strut pairs are disposed parallel to each other and a folding frame open position in which struts of the at least three strut pairs are locked in non-parallel positions and ends of the struts of each strut pair of the at least three strut pairs define a rectangle. The folding leg assembly comprises two leg strut assemblies, each leg strut assembly including a top leg strut and a tubular bottom leg strut in which the top leg strut is telescopingly slidable between a top leg strut closed position and a top leg strut open position, a top end of each top leg strut including a joint for pivotable attachment to an end of a strut of a strut pair of the at least three strut pairs of the folding frame system, a lock for locking the top leg strut in the top leg strut open position, two arm strut assemblies, each arm strut assembly corresponding to a respective leg strut assembly, each arm strut assembly being pivotably attached at a bottom end to a point on the bottom leg strut of the respective leg strut assembly, a top end of each arm strut assembly including a joint for pivotable attachment to, the folding frame system, wherein the two leg strut assemblies are pivotably attached to each other at bottom ends of bottom leg struts of the two leg strut assemblies, top ends of top leg struts of the two leg strut assemblies each including a joint for pivotable attachment to top ends of struts of a strut pair of the at least three strut pairs, top ends of arm strut assemblies of the two arm strut assemblies each including a joint for pivotable attachment to bottom ends of the struts of the strut pair, and a foot assembly for pivotably attaching the two leg strut assemblies to each other at bottom ends of the bottom leg struts of the two leg strut assemblies, the foot assembly permitting pivotal movement of the two leg strut assemblies, the foot assembly comprising an elongated U-shaped bracket having two legs connected by a web, holes through legs of the bracket at opposite first and second ends of the bracket, the first and second ends of the bracket receiving respective ones of the bottom ends of the bottom leg struts of the two leg strut assemblies between the two legs of the U-shaped bracket, the bottom end of each bottom leg strut of the two leg strut assemblies being pivotably attached to the U-shaped bracket by a respective foot pin extending through the two legs of the U-shaped bracket and the bottom end of the bottom leg strut.

BRIEF DESCRIPTION OF THE DRAWINGS

The features and advantages of the present invention are well understood by reading the following detailed description in conjunction with the drawings in which like numerals indicate similar elements and in which:

FIGS. 3A-3C show a V-shaped leg assembly according to an aspect of the present invention in an erected condition in a front view, a left side view, and a right side view, respectively, and FIG. 3D shows a right side view of the V-shaped leg assembly of FIGS. 3A-3C in a folded condition;

DETAILED DESCRIPTION

Figure 1A:
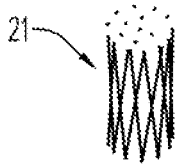
FIGS. 1A-1C show perspective views of a folding frame system according to an aspect of the present invention in a folded condition, an expanded but unerected condition, and an erected condition, respectively.
Figure 1B:
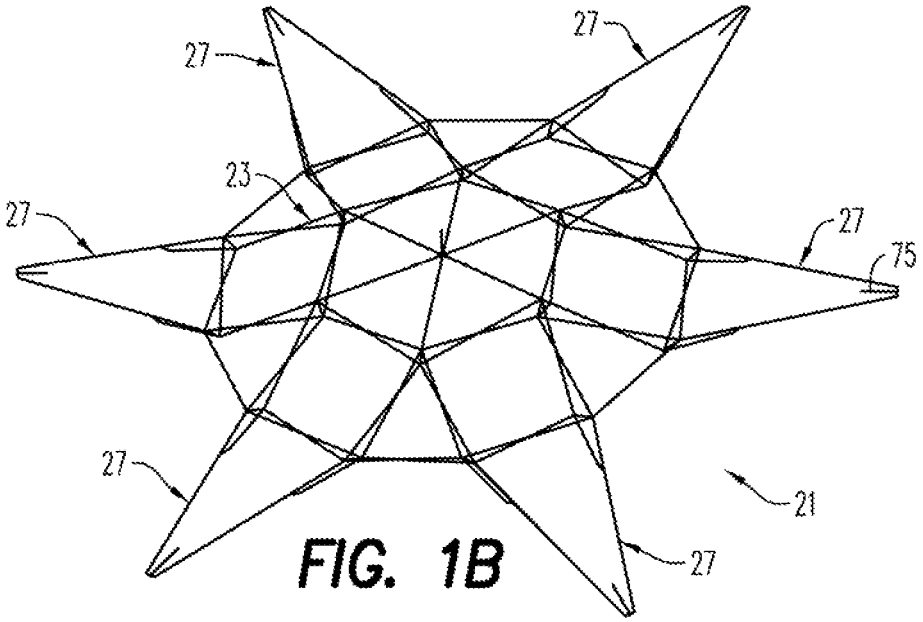
Figure 1C:
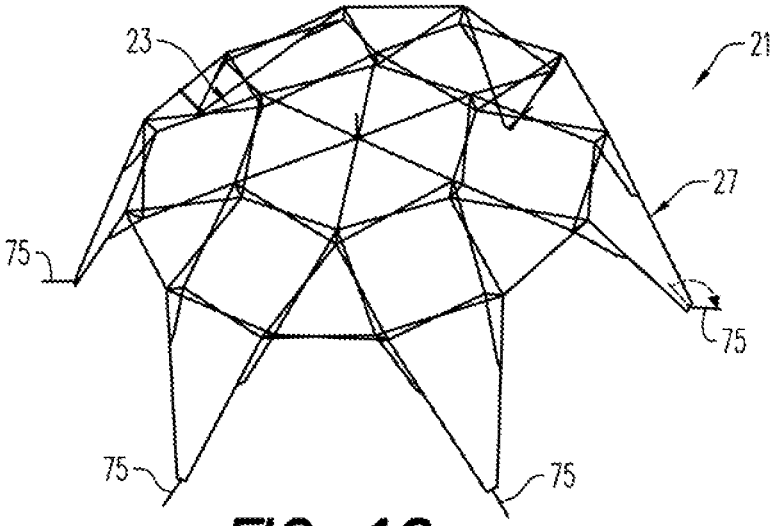
Figure 2F:
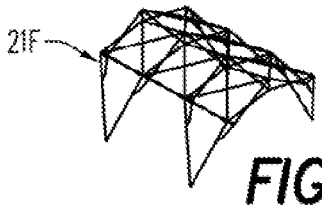
FIGS. 2A-2K show perspective views of embodiments of folding frame systems according to aspects of the present invention.
Figure 2A:
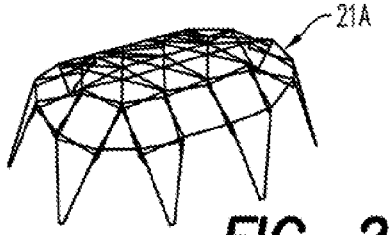
Figure 2G:
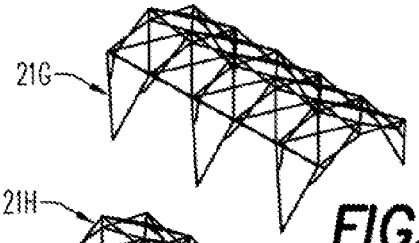
Figure 2B:
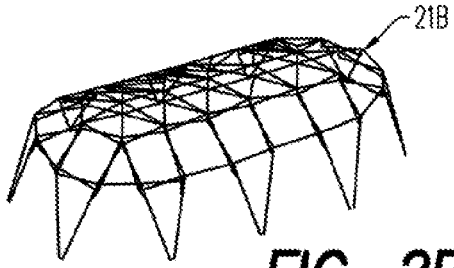
Figure 2H:
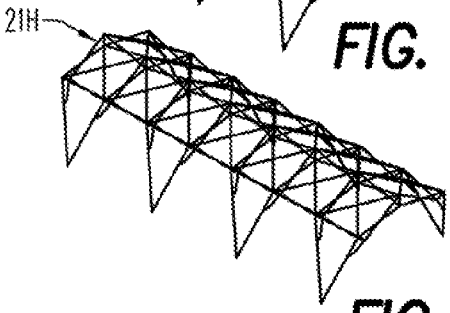
Figure 2C:
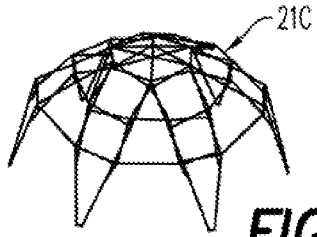
Figure 2I:
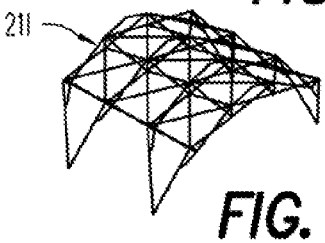
Figure 2D:
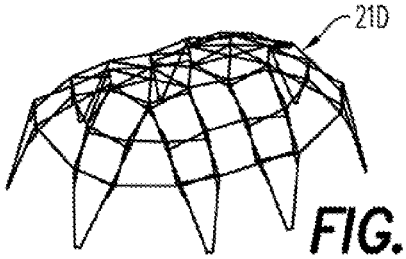
Figure 2J:
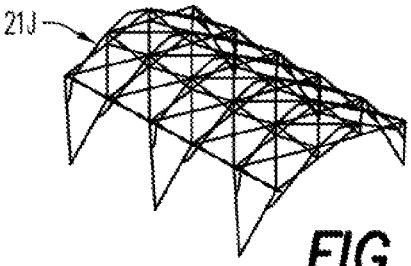
Figure 2E:
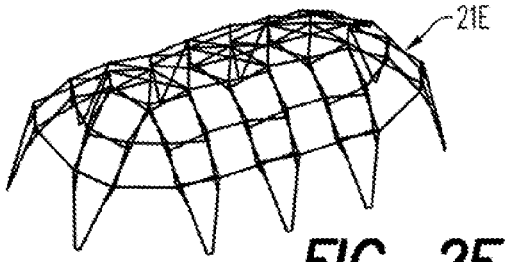
Figure 2K:
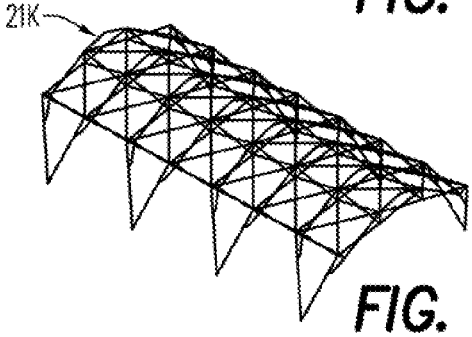

A folding frame system 21 according to an aspect of the present invention is seen in FIGS. 1A-1C. The folding frame system 21 is movable between a folded condition as shown in FIG. 1A to a flat, unfolded, unerected condition shown in FIG. 1B to an unfolded, erected condition as shown in FIG. 1C. The folding frame system 21 shown in FIGS. 1A-1B is merely one type of folding frame system and a number of variations 21A-21K on the system shown in FIGS. 1A-1C can be provided, as seen in FIGS. 2A-2K.

For purposes of discussion, the folding frame system 21 of FIGS. 1A-1C will be referred to, it being appreciated that the discussion applies as well to other forms of folding frame systems such as the folding frame systems 21A-21K shown in FIGS. 2A-2K except where otherwise indicated. The folding frame system 21 includes a roof assembly 23 including at least three, typically four, pivotably attached strut pairs 25. Adjacent pairs of at least three pivotably attached strut pairs 25 define at least three corners of the roof assembly 23. The roof assembly 23 is movable between a roof assembly closed position (FIG. 1A) in which struts of the at least three strut pairs 25 are disposed parallel to each other and a roof assembly open position (FIG. 1C) in which struts of the at least three strut pairs are locked in non-parallel positions and ends of the struts, of each strut pair of the at least three strut pairs define a rectangle.

Each folding frame system 21 includes at least one folding V-shaped leg assembly 27 attached to the roof assembly 23. The folding frame system 21 of FIGS. 1A-1C includes six folding leg assemblies 27.

As seen in FIGS. 3A-3D, each folding leg assembly 27 comprises two leg strut assemblies 29*a* and 29*b*, each leg strut assembly including a top leg strut 31*a* and 31*b* and a tubular bottom lea strut 33*a* and 33*b* in which the top leg strut is telescopingly slidable between a top lea strut closed position (FIG. 3D) and a top leg strut open position (FIGS. 3A-3B). A top end 35*a* and 35*b* of each top leg strut 31*a* and 31*b* includes a joint 37*a* and 37*b* for pivotable attachment to an end of a strut of a strut pair 25 of the at least three strut pairs of the roof assembly 23.

A lock 39 for locking the top leg strut 31*a* and 31*b* in the top lea strut open position relative to the bottom leg strut 33*a* and 33*b* is provided. The lock 39 can be in any suitable form, such as in the form of a spring-loaded pin or button 41 disposed in a tubular top leg strut 31*a* and 31*b* with an end of the pin or button extending out of a hole 43 in a wall of the tubular top leg strut, and that is adapted to be received in a hole 45 in a tubular bottom leg strut 33*a* and 33*b* to prevent axial movement of the tubular top lea strut and tubular bottom lea strut relative to each other. By compressing the spring of the spring-loaded pin or button 41, the pin or button can be moved out of the hole 45 in the tubular bottom leg strut 33*a* and 33*b* so that the tubular bottom leg strut can be moved axially relative to the tubular top leg strut 31*a* and 31*b*.

The folding leg assembly 27 further includes two arm strut assemblies 47*a* and 47*b*. Each arm strut assembly 47*a* and 47*b* corresponds to a respective leg strut assembly 29*a* and 29*b*. Each arm strut assembly 47*a* and 47*b* is pivotably attached at a bottom end 49*a* and 49*b* of the arm strut assembly 47*a* and 47*b* to a point 51*a* and 51*b* on the bottom lee strut 33*a* and 33*b* of the respective leg strut assembly 29*a* and 29*b*. As shown in U.S. Pat. No. 6,141,934, which is incorporated by reference, each arm strut assembly 47*a* and 47*b* is preferably pivotably attached to the bottom kg strut 33*a* and 33*b* by means of a substantially U-shaped bracket 53 that preferably includes a rounded port ion for receiving the bottom leg strut and two substantially flat legs between which the bottom end 49*a* and 49*b* of the at strut assembly 47*a* and 47*b* is pivotally mounted by a pin.

A top end 55*a* and 55*b* of each arm strut assembly includes a joint 57*a* and 57*b* similar to the joint 37*a* and 37*b* for pivotable attachment to an end of a strut of a strut pair 25 of the at least three strut pairs of the folding frame system, 23.

The two leg strut assemblies 29*a* and 29*b* are pivotably attached to each other at bottom ends 59*a* and 59*b* of bottom leg struts 33*a* and 33*b* of the two leg strut assemblies. The joints 37*a* and 37*b* at the top ends 35*a* and 35*b* of the top leg struts 31*a* and 31*b* of the two leg strut assemblies 29*a* and 29*b* are each being pivotably attached to top ends (on an outside of the erected folding frame system) of struts of the strut pair 25 of the at least three strut pairs. The joints 57*a* and 57*b* at the top ends 55*a* and 55*b* of the an strut assemblies 47*a* and 47*b* are each being pivotably attached to bottom ends (on an inside of the erected folding frame system) of the struts of the strut pair 25.

A foot assembly 61 is provided for pivotably attaching the two leg strut assemblies 29*a* and 29*b* to each other at bottom ends 59*a* and 59*b* of the bottom lee struts 33*a* and 33*b* of the two leg strut assemblies. The foot assembly 61 permits pivotal movement of the two leg strut assemblies 29*a* and 29*b*. The foot assembly 61 comprises a first U-shaped bracket 63 having two legs 65*a* and 65*b* connected by a web 67, a second U-shaped bracket 69 having two legs 71*a* and 71*b* connected by a web 73, a cylindrical foot member 75, and a pivot pin 77 extending through a hole 79 in the web of the first bracket, a hole 81 in the foot member, and a hole 83 in the web of the second bracket so that the first bracket, the foot member, and the second bracket are all pivotable relative to one another about the pivot pin. Each of the first and, second U-shaped brackets 63 and 69 receive one of the bottom ends 59*a* and 59*b* of the bottom leg struts 33*a* and 33*b* of the two leg strut assemblies 29*a* and 29*b* between the two legs of the U-shaped bracket. The bottom end 59*a* and 59*b* of each bottom leg strut 33*a* and 33*b* of the two leg strut assemblies 29*a* and 29*b* is pivotably attached to a respective U-shaped bracket 63 and 69 by a respective foot pin 85 extending through the two legs of the U-shaped bracket and the bottom end of the bottom leg strut.

Figure 4B:
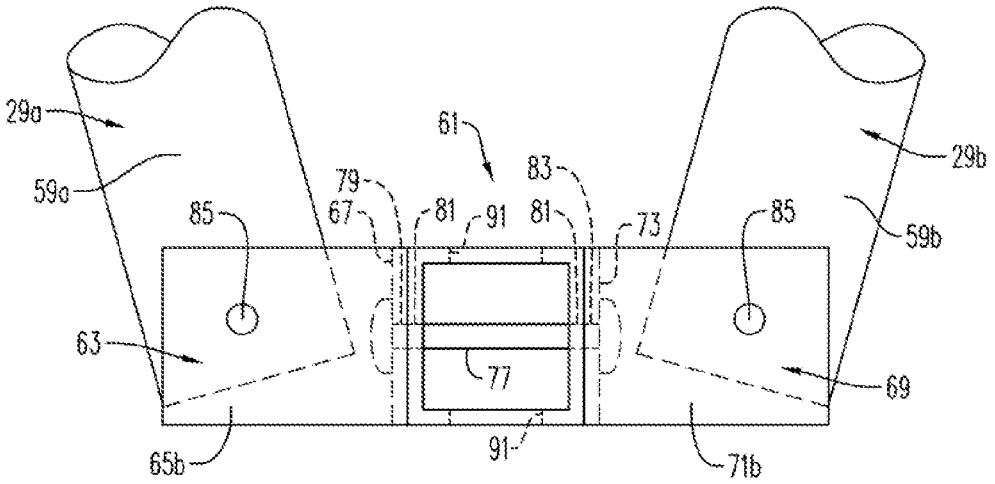
FIGS. 4A-4C show a folding foot assembly according to an aspect of the present invention in a perspective view, a side view, and a top view, respectively.
Figure 4C:
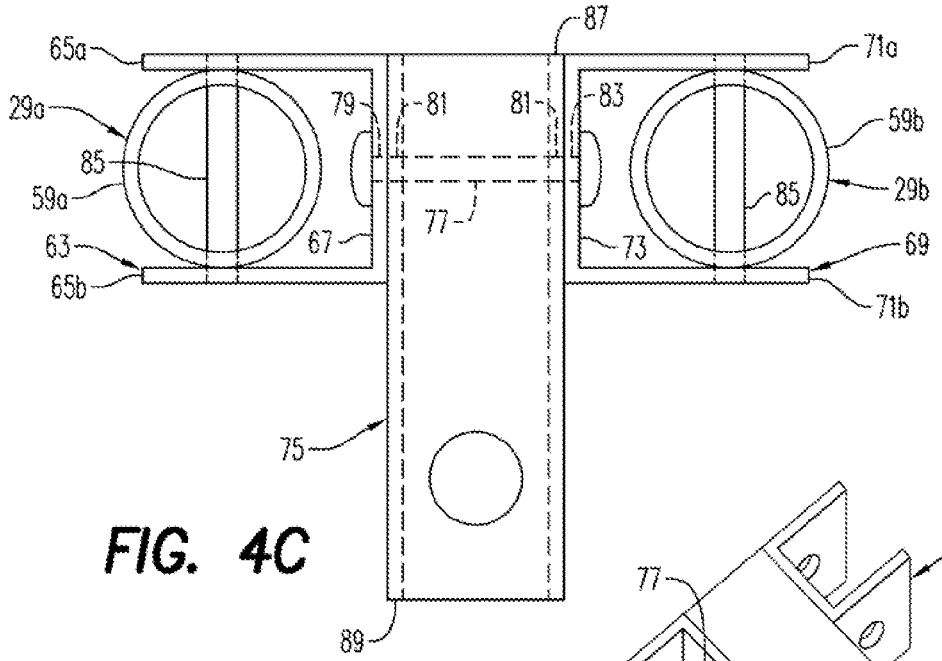
Figure 4A:
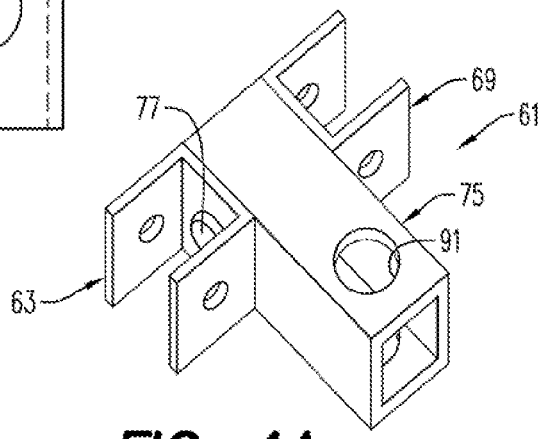

The foot member 75 can be solid but, as seen in FIGS. 4A-4C, is ordinarily tubular. By providing a solid or tubular foot member 75, it is possible to reduce the possibility of the leg strut assemblies 29*a* and 29*b* and the U-shaped brackets 63 and 69 crushing the foot member such that it is difficult for the leg strut assemblies to pivot relative to each other, which can make it difficult to erect or break down a folding frame system.

The foot member 75 can be rectangular in a cross-section perpendicular to a longest dimension of the foot member. The foot member 75 has a first end 87 and a second end 89, and the hole 81 in the foot member is ordinarily closer to the first end than to the second end. The foot member 75 typically comprises a second hole 91 closer to the second end 89 than to the first end, the second hole being perpendicular to the first hole 81 and perpendicular to the longest dimension of the foot member. The second hole 91 can receive a stake or bolt for securing the folding frame system 21 to the ground.

When erecting a folding frame system 21 as seen in FIGS. 1A-1C, upon reaching the open position in FIG. 1C, each foot member 75 (FIGS. 3A-4C) can be turned outward from its respective folding leg assembly 27 as seen in the illustrative folding frame system 21 shown in FIG. 1C so that the foot member lies flat on the underlying surface, regardless whether the surface might be sloped or otherwise irregular. A stake or bolt (not shown) can extend through the second hole 91 in the foot member to secure the folding leg assembly 27 in position. When breaking the folding frame system down to the condition shown in FIG. 1A, after removal of the stake or bolt, the foot member 75 can be folded up between the leg strut assemblies 29*a* and 29*b*.

Figure 5B:
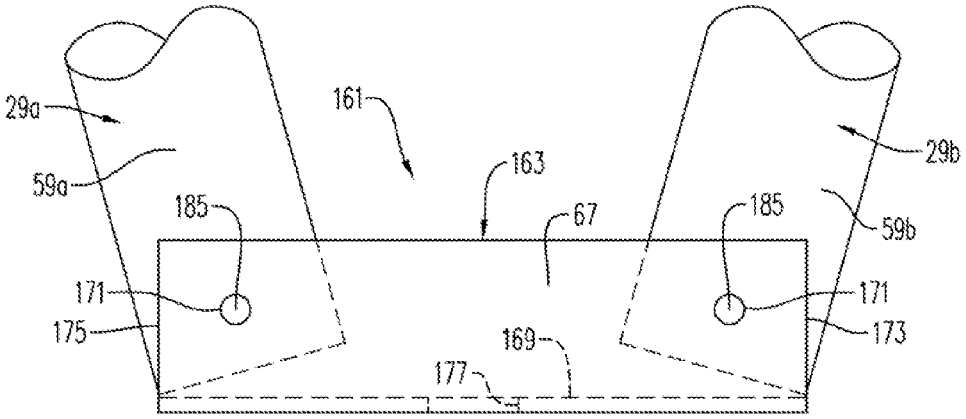
FIGS. 5A-5C show a folding foot assembly according to another aspect of the present invention in a perspective view, a side view, and a top view, respectively.
Figure 5C:
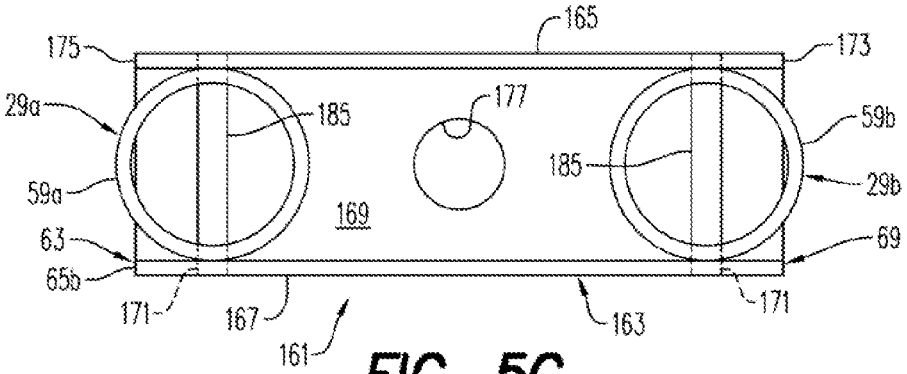
Figure 5D:
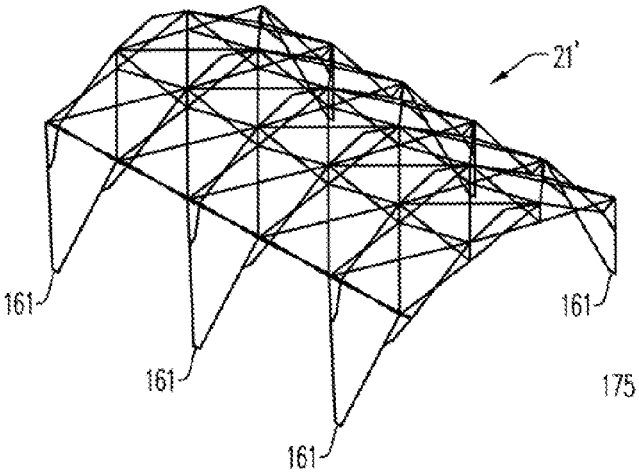
FIG. 5D shows a perspective view of a folding frame system including a folding foot assembly of the type shown in FIGS. 5A-5C according to an aspect of the present invention.
Figure 5A:
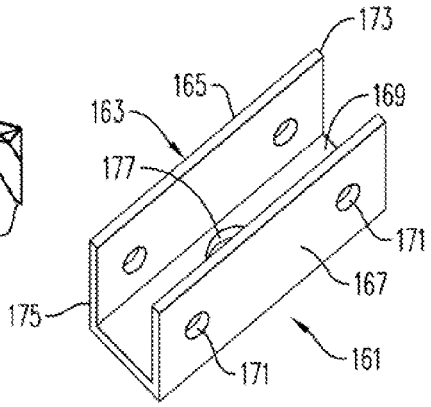

FIGS. 5A-5C show another form of foot assembly 161 for pivotably attaching the two leg strut assemblies 29*a* and 29*b* to each other at bottom ends 59*a* and 59*b* of the bottom left struts 33*a* and 33*b* of the two leg strut assemblies, the foot assembly permitting pivotal movement of the two leg strait assemblies, that can be used as an alternative to the foot assembly 61 shown in FIGS. 4A-4C. FIG. 5D shows the foot assembly 161 on an erected folding frame system 21'.

The foot assembly 161 includes an elongated U-shaped bracket 163 having two legs 165 and 167 connected by a web 169, with holes 171 through legs of the bracket at opposite first and second ends 173 and 175 of the bracket. The first and second ends 173 and 175 of the bracket 163 receive respective ones of the bottom ends 59*a* and 59*b* of the bottom leg struts 33*a* and 33*b* of the two leg strut assemblies 29*a* and 29*b* between the two legs 165 and 167 of the U-shaped bracket. The bottom end 59*a* and 59*b* of each bottom leg strut 33*a* and 33*b* of the two leg strut assemblies 29*a* and 29*b* is pivotably attached to the U-shaped bracket by a respective foot pin 185 extending through the two legs 173 and 175 of the U-shaped bracket and the bottom end of the bottom leg strut. The bracket 163 comprises a second hole 177 in the web 169 of the U-shaped bracket for receiving a structure such as a stake or a bolt for securing the folding frame system relative to a surface. The second hole 177 is ordinarily midway between the first and second ends of the bracket. The foot assembly 161 facilitates providing a simple to manufacture foot assembly that provides for relative movement of the leg strut assemblies 29*a* and 29*b* and requires no action on the part of the user to unfold any component of the foot assembly.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A folding leg assembly for a folding frame system, the folding frame system including at least three pivotably attached strut pairs, the folding frame system being movable between a folding frame closed position in which struts of the at least three strut pairs are disposed parallel to each other and a folding frame open position in which struts of the at least three strut pairs are locked in non-parallel positions and ends of the struts of each strut pair of the at least three strut pairs define a rectangle, the folding leg assembly comprising:

two leg strut assemblies, each leg strut assembly including a top leg strut and a tubular bottom leg strut in which the top leg strut is telescopingly slidable between a top leg strut closed position and a top leg strut open position;

a lock for locking the top leg strut in the top leg strut open position;

two arm strut assemblies, each arm strut assembly corresponding to a respective leg strut assembly, each arm strut assembly being pivotably attached at a bottom end to a point on the bottom leg strut of the respective leg strut assembly;

wherein the two leg strut assemblies are pivotably attached to each other at bottom ends of bottom leg struts of the two leg strut assemblies, top ends of top leg struts of the two leg strut assemblies each including a joint for pivotable attachment to top ends of struts of a strut pair of the at least three strut pairs, top ends of arm strut assemblies of the two arm strut assemblies each including a joint for pivotable attachment to bottom ends of the struts of the strut pair; and a foot assembly for pivotably attaching the two leg strut assemblies to each other at bottom ends of the bottom leg struts of the two leg strut assemblies, the foot assembly permitting pivotal movement of the two leg strut assemblies, the foot assembly comprising an elongated U-shaped bracket having two legs connected by a web, holes through legs of the bracket at opposite first and second ends of the bracket, the first and second ends of the bracket receiving respective ones of the bottom ends of the bottom leg struts of the two leg strut assemblies between the two legs of the U-shaped bracket, the bottom end of each bottom leg strut of the two leg strut assemblies being pivotably attached to the U-shaped bracket by a respective foot pin extending through the two legs of the U-shaped bracket and the bottom end of the bottom leg strut.

2. The folding leg assembly as set forth in claim 1, wherein the bracket comprises a second hole in the web of the bracket.

3. The folding leg assembly as set forth in claim 2, wherein the second hole is midway between the first and second ends of the bracket.

* * * * *